United States Patent [19]

Noguchi et al.

[11] Patent Number: 4,819,927

[45] Date of Patent: Apr. 11, 1989

[54] FLAT ARTICLE FEEDING APPARATUS COMPRISING A PLURALITY OF REVERSEDLY DRIVEN AND INDIVIDUALLY URGED PULLEYS

[75] Inventors: Masahiko Noguchi; Kiyoshi Tsuda; Tsutomu Sasage, all of Tokyo, Japan

[73] Assignee: NEC Corporation, Japan

[21] Appl. No.: 176,732

[22] Filed: Apr. 1, 1988

[30] Foreign Application Priority Data

Apr. 2, 1987 [JP] Japan ..... 62-82321
Apr. 2, 1987 [JP] Japan ..... 62-82322

[51] Int. Cl.[4] ..... B65H 3/04

[52] U.S. Cl. ..... 271/34; 271/3; 271/198

[58] Field of Search ..... 271/34, 35, 3, 4–7, 271/10, 109, 128, 129, 150, 69, 306, 198, 1–2

[56] References Cited

U.S. PATENT DOCUMENTS 4,431,175 2/1984 Smith ..... 271/34 X
4,462,586 7/1984 Browne et al. ..... 271/34 X
4,475,732 10/1984 Clausing et al. ..... 271/34 X
4,541,624 9/1985 Sasage et al. ..... 271/12
4,678,175 7/1987 Arldt et al. ..... 271/34
4,691,913 9/1987 Frank ..... 271/34

*Primary Examiner*—Douglas C. Butler
*Attorney, Agent, or Firm*—Laff, Whitesel, Conte & Saret

[57] ABSTRACT

Flat article feeding apparatus comprises a feeder comprising a feed belt for feeding approximately flat articles one by one in a feeding direction and a predetermined number of idler pulleys. The idler pulleys are individually urged towards the feed belt so that the idler pulleys are in contact with one of the flat articles that is fed on the feed belt as a particular article. The idler pulleys are driven so as to feed the particular article reversedly relative to the feeding direction. The apparatus is applicable to feeding the flat articles successively to a utilizing device which is typically a bar code printer. For this purpose, the feeder and the idler pulleys are controllably driven in response to a completion signal which the utilizing device produces upon completion of a predetermined process.

9 Claims, 6 Drawing Sheets

FLAT ARTICLE FEEDING APPARATUS COMPRISING A PLURALITY OF REVERSEDLY DRIVEN AND INDIVIDUALLY URGED PULLEYS

BACKGROUND OF THE INVENTION

This invention relates to apparatus for feeding a plurality of approximately flat articles, such as envelopes and postcards.

Flat article feeding apparatus of the type described is disclosed in U.S. Pat. No. 4,541,624 issued to Tsutomu Sasage et al and assigned to NEC Corporation. For use typically in a mail sorting system, the apparatus of Sasage et al comprises a feeder for feeding the flat articles to another section such as a sorting section. The feeder comprises an endless feed belt defining a feed plane at a predetermined portion thereof. Ordinarily, the feeder feeds the flat articles one by one with each of the flat articles fed substantially along the feed plane. However, the feeder sometimes feeds two or more of the flat articles at a time to the other section. Feed of two or more of the flat articles will hereafter be called an overlap feed and should be avoided.

In order to avoid the overlap feed, a reversedly driven roller is well known in the art. The reversedly driven roller is urged by a spring towards the feed plane so that the reversedly driven roller is in contact with one of the flat articles that is fed on the feed plane as a particular article. The reversedly driven roller reversedly feeds another flat article overlapping the particular article. As a result, the feed belt feeds only the particular article outwardly of the feed belt.

It is to be noted in this connection that the flat articles, in particular the envelopes, may often have a thick or swelling portion caused by contents of the envelope. In this event, the conventional reversedly driven roller can not avoid the overlap feed. This is because the reversedly driven roller is a single roller and because the reversedly driven roller is brought into contact with only a part of the particular article. The overlap feed causes an unstable feed of the flat articles with at least one of the flat articles in a skewed position.

SUMMARY OF THE INVENTION

It is therefore an object of this invention to provide flat article feeding apparatus which is capable of avoiding an overlap feed.

Other objects of this invention will become clear as the description proceeds.

Flat article feeding apparatus to which this invention is applicable is for use in feeding a plurality of approximately flat articles. According to this invention, the apparatus comprises an endless feed belt defining a feed plane at a predetermined portion thereof. First driving means drives the endless feed belt to make the endless feed belt feed the flat article one by one with each of the flat articles fed substantially along the feed plane. The apparatus further comprises a predetermined number of idler pulleys. Pulley supporting means supports the idler pulleys substantially perpendicular to the feed plane. Urging means individually urges the idler pulleys towards the feed plane so that the idler pulleys are in contact with one of the flat articles that is fed on the feed plane as a particular article. Second driving means drives the idler pulleys to make the idler pulleys reversedly feed the particular article.

DESCRIPTION OF THE PREFERRED EMBODIMENTS

Figure 1:
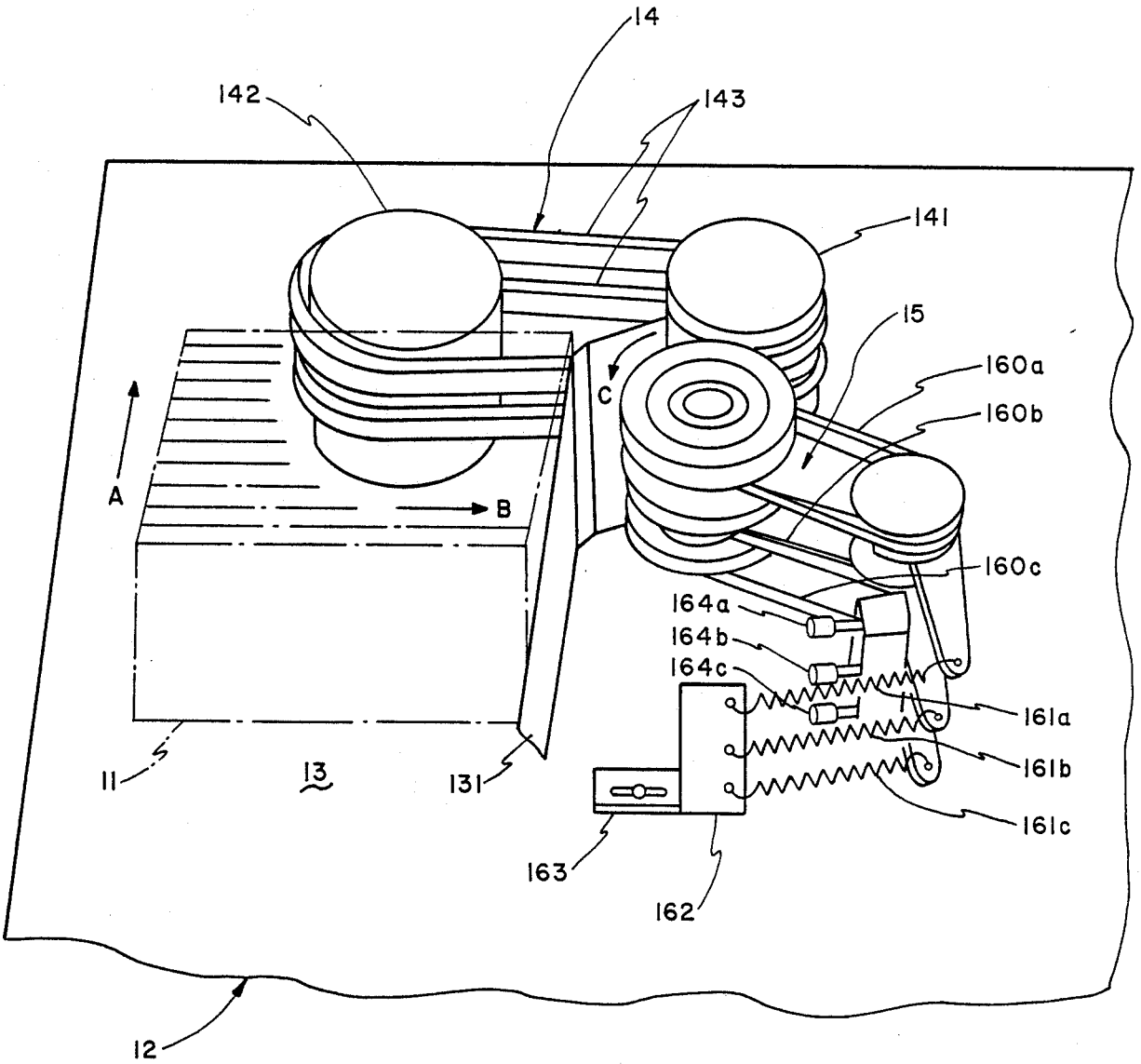
FIG. 1 is a perspective view of flat article feeding apparatus according to a first embodiment of this invention.
Figure 2:
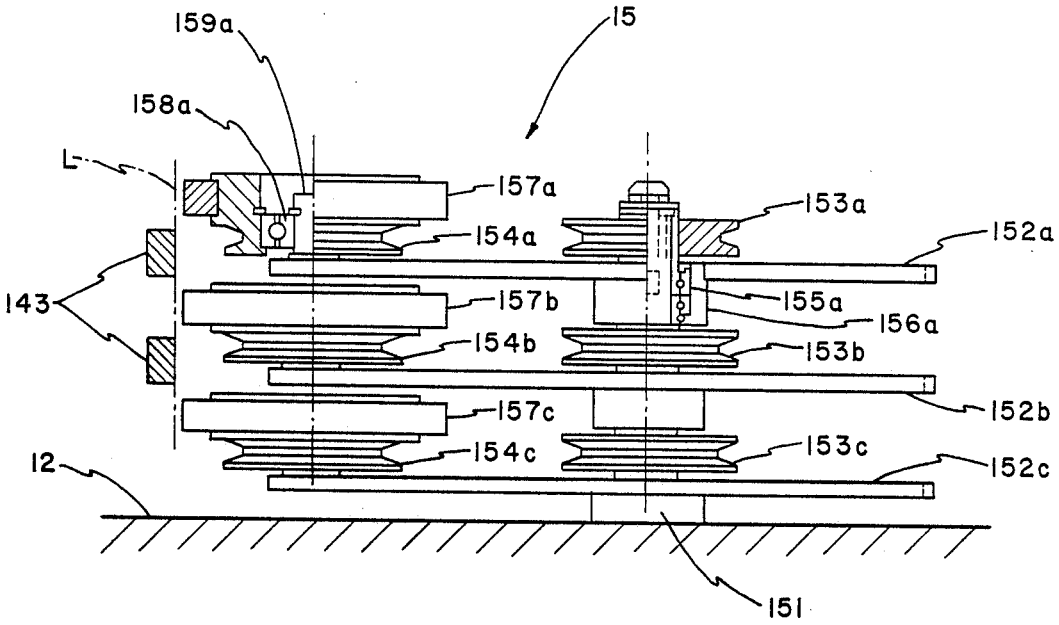
FIG. 2 is a partly sectional side view of a reversedly driven pulley mechanism illustrated in FIG. 1.

Referring to FIGS. 1 and 2, flat article feeding apparatus according to a first embodiment of this invention is for use in feeding substantially or approximately flat articles (collectively depicted at 11 in FIG. 1) one by one as output articles outwardly of the apparatus to a utilizing device which will later be illustrated.

The apparatus comprises a horizontal base member 12 on which a stacker 13, a feeder 14, and a reversedly driven pulley mechanism 15 are mounted. The stacker 13 is for a stack of the flat articles 11 on a predetermined area of the base member 12 in an upright state. It will be assumed that the flat articles 11 are postcards and envelopes enclosing contents, such as letters. In the manner which will later be illustrated, the stacker 13 comprises a conveyor for conveying the flat articles 11 in a first direction indicated by an arrow A. The first direction will hereafter be called a conveying direction. The stacker 13 further comprises a side plate 131 vertically fixed to the base member 12 and has a portion extending parallel to the conveying direction to a position near the feeder 14. The side plate 131 is for aligning front ends of the flat articles 11 and guiding the flat articles 11 conveyed by the conveyor.

The feeder 14 comprises a driving roller 141, a following roller 142, and a pair of endless feed belts 143 wound around the driving roller 141 and the following roller 142. The driving roller 141 and the following roller 142 are rotatably supported on the base member 12 with their axes positioned vertically. The driving roller 141 is driven by a motor called a common motor for the reason which will later become clear.

Through the driving roller 141, the feed belts 143 are driven in a second direction depicted by another arrow B. The second direction will hereafter be called a feeding direction. The feed belts 143 are made of a high friction material, such as rubber, and define a feed plane on which the flat articles 11 are fed. The feed plane is shown in FIG. 2 by dashed-dot lines labelled L. The feed belts 143 feed, as a particular article, each of the flat articles 11 that is brought into contact with the feed belts 143 by the conveyor.

In the manner best shown in FIG. 2, the reversedly driven pulley mechanism 15 comprises a driving shaft 151, first through third arms 152*a*, 152*b*, and 152*c*, first through third driving pulleys 153*a*, 153*b*, and 153*c*, and first through third idler pulleys 154*a*, 154*b*, and 154*c*. The idler pulleys 154*a* to 154*c* have a common thickness. The driving shaft 151 is rotatably supported on the base member 12 with its axis held vertically and is driven by a separate motor which is different from the common motor. The first through the third driving pulleys 153*a* to 153*c* are fixed to the driving shaft 151 to be driven by the driving shaft 151 at a common rotational speed. The first through the third arms 152*a* to 152*c* are swingably supported by the driving shaft 151 with a predetermined space left between two adjacent ones of the first through the third arms 152*a* to 152*c*. The predetermined space is greater than the common thickness of the idler pulleys 154*a* to 154*c*.

More particularly referring to FIG. 2, the first arm 152*a* has a through hole at a middle portion thereof. The driving shaft 151 passes through the through hole. The first arm 152*a* is supported by the driving shaft 151 through a first ball bearing 155*a* and a first cylindrical member 156*a* which is fixed to the first arm 152*a* and serves to keep the predetermined space. The second and the third arms 152*b* and 152*c* are likewise supported by the driving shaft 151. Thus, the first through the third arms 152*a* to 152*c* are individually swingable around the driving shaft 151.

The first through the third idler pulleys 154*a* to 154*c* have first through third rims 157*a*, 157*b*, and 157*c* which are fixed around peripheries of the first through the third idler pulleys 154*a* to 154*c*, respectively. Each of the first through the third rims 157*a* to 157*c* is made of a material having a friction factor which is not greater than that of the feed belts 143.

The first idler pulley 154*a* is rotatably supported through another first ball bearing 158*a* by a shaft 159*a* upwardly protruded from one end portion of the first arm 152*a*. The second and the third idler pulleys 154*b* and 154*c* are similarly rotatable. The first through the third arms 152*a* to 152*c* serve as collectively a pulley supporting arrangement for supporting the first through the third idler pulleys 154*a* to 154*c* substantially perpendicular to the feed plane. In addition, it is desirable that upper feed belt and lower feed belt of the feed belts 143 are interposed between two adjacent ones of the first through third idler pulleys 154*a* to 154*c*.

In FIG. 2, first through third endless driving belts 160*a*, 160*b*, and 160*c* are wound around the first through the third driving pulleys 153*a* to 153*c* and the first through the third idler pulleys 154*a* to 154*c*, respectively. Thus, all of the first through the third idler pulleys 154*a* to 154*c* are driven by the driving shaft 151 in a predetermined rotating direction depicted in FIG. 1 at a third arrow C. The predetermined rotating direction is determined so as to feed the particular article reversedly relative to the feeding direction.

In FIG. 1, first through third extension springs 161*a*, 161*b*, and 161*c* have their one end portions fixed to other end portions of the first through the third arms 152*a* to 152*c*, respectively. Other end portions of the first through the third extension springs 161*a* to 161*c* are fixed to a bracket 162 which is adjustably attached to the base member 12 by the use of a screw 163.

Each of the first through the third extension springs 161*a* to 161*c* is for pushing the first through the third idler pulleys 154*a* to 154*c* away from the bracket 162 through the first through the third arms 152*a* to 152*c*. Thus, the first through the third idler pulleys 154*a* to 154*c* are individually urged towards the feed plane of the feed belts 143 so that the first through the third idler pulleys 154*a* to 154*c* are in contact with one of the flat articles 11 that is fed on the feed plane as the particular article. The bracket 162 serves as an adjusting member movable relative to the driving shaft 151.

First through third set screws 164*a*, 164*b*, and 164*c* are attached to a pole 165 fixed upright to the base member 12. The set screws 164*a* to 164*c* have their front ends protruded away from the pole 165 to be in contact with the first through the third arms 152*a* to 152*c*. The first through the third set screws 164*a* to 164*c* are individually adjustable to position the front ends.

The first set screw 164*a* holds the first arm 152*a* against the first extension spring 161*a*. Thus, the first idler pulley 154*a* is held at a desired position which is adjacent to the feed plane of the feed belts 143. Similarly, the second and the third idler pulleys 154*b* and 154*c* are individually held at desired positions, respectively. A combination of the first through the third extension springs 161*a* to 161*c*, the first through the third set screws 164*a* to 164*c*, and the bracket 162 serves as an urging unit for individually urging the first through the third idler pulleys 154*a* to 154*c* with an adjustable force.

Figure 3:
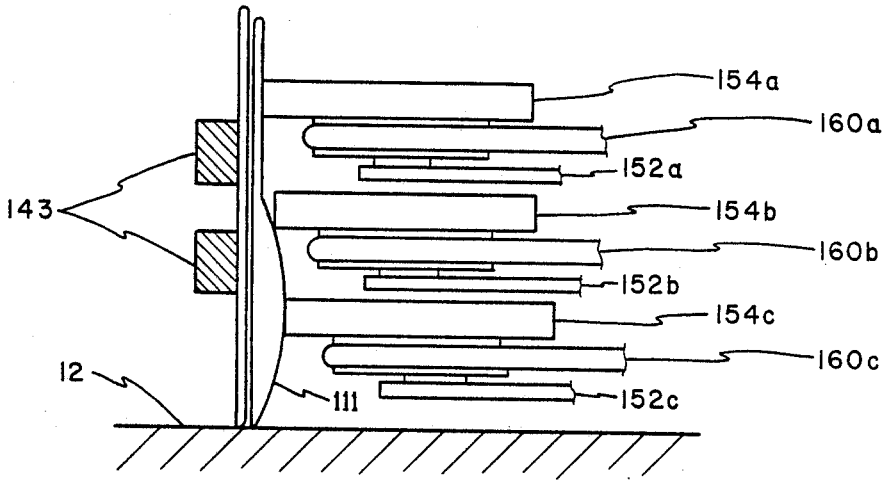
FIG. 3 is a partly side view for use in describing operation of a reversedly driven pulley mechanism illustrated in FIG. 1.

Referring afresh to FIG. 3 together with FIGS. 1 and 2, description will be made as regards operation of the reversedly driven pulley mechanism 15. The flat articles 11 are conveyed in the conveying direction A by the conveyor described before. The feeder 14 feeds the particular article to a path between the feed plane and the first through the third idler pulleys 154*a* to 154*c*. When only the particular article arrives at the path, the first through the third idler pulleys 154*a* to 154*c* allow the particular article to pass through the path regardless of the size and the shape of the particular article. If another flat article arrives at the path next following the particular article as a next following article, the next following article may become overlapped on the particular article as an overlapped article. Even in this event, the overlapped article is reversedly fed by the first through the third idler pulleys 154*a* to 154*c*. As a result, the particular article is fed through the path outwardly of the feeder 14 with the overlapped article rejected from the particular article.

If the overlapped article has a thick or swelling portion best depicted in FIG. 3 at 111, all of the first through the third idler pulleys 154*a* to 154*c* are in contact with the overlapped article. In other words, the first through the third idler pulleys 154*a* to 154*c* individually change their positions according to the thickness of the overlapped article. This is the reason why the reversedly driven pulley mechanism 15 avoids the overlap feed.

Figure 4:
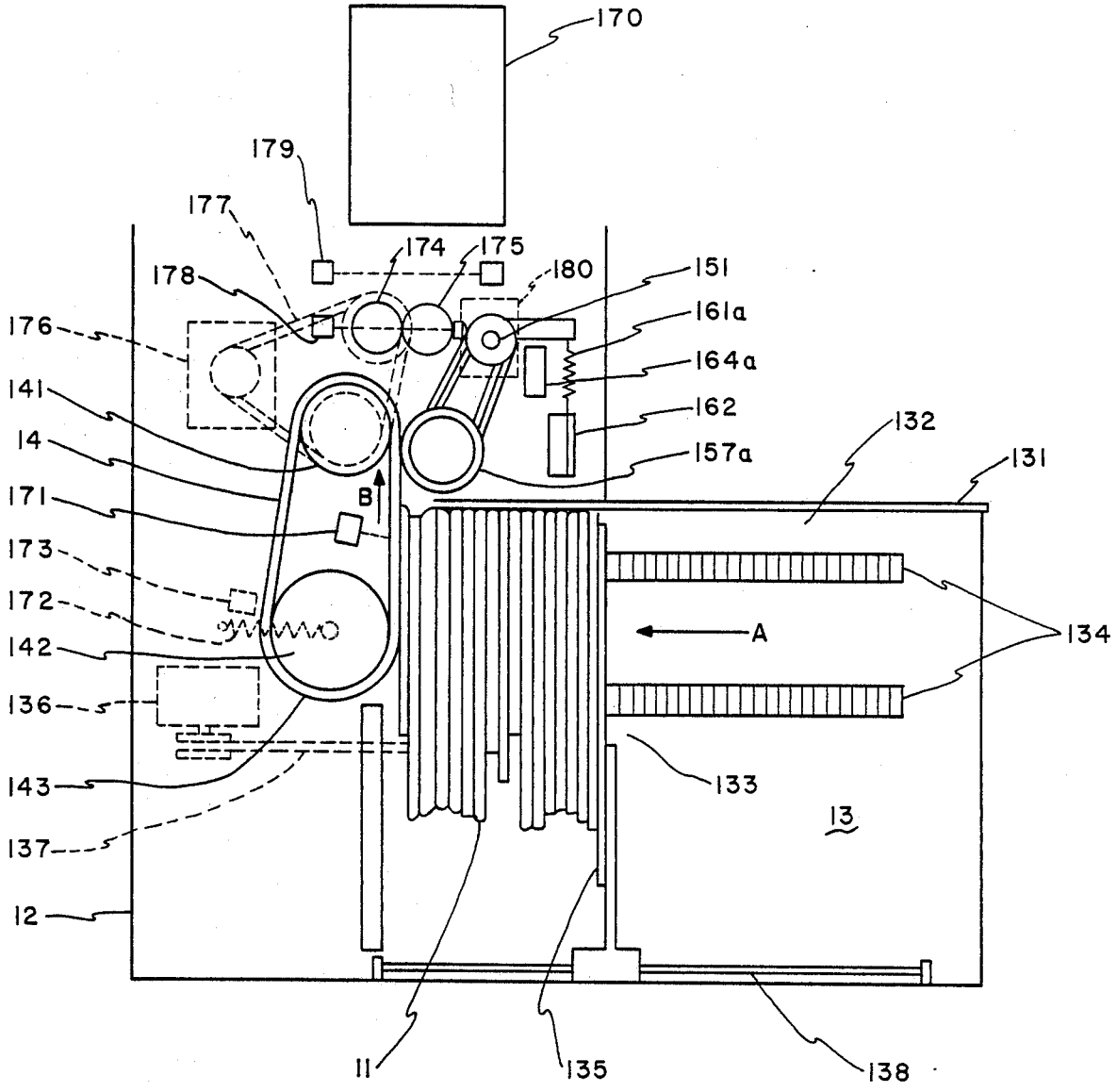
FIG. 4 is a schematic plan view of flat article feeding apparatus according to a second embodiment of this invention.

Referring to FIG. 4, the description will further proceed to flat article feeding apparatus according to a second embodiment of this invention. The flat article feeding apparatus is for use in combination with a utilizing device such as a bar code printer (depicted at 170), which is coupled to a keyboard manually operated by an operator to input a zip code number. The apparatus comprises similar parts designated by like reference numerals.

The stacker 13 comprises a horizontal main plate 132 and a conveyor 133 for conveying the flat articles 11 in the conveying direction A. The conveyor 133 comprises a pair of conveyor belts 134 and a back plate 135 coupled to the conveyor belts 134 to push the flat articles 11. It will be assumed that each of the flat articles 11 has an addressed-surface on which an address is written. In the case, the flat articles 11 are arranged with their addressed-surfaces directed in unidirection and are held substantially vertically on the conveyor belts 134 by the back plate 135. The conveyor belts 134 are extended along the main plate 132 in the conveying direction A. Each of the conveyor belts 134 has teeth spaced apart with a recessed portion left between two adjacent ones of the teeth. The conveyor belts 134 are driven in the conveying direction by a driver (not shown). The driver is placed under the base member 12 and comprises a conveyor motor 136 and an endless belt 137. The conveyor motor 136 is controller by a controller which will later be described in detail.

The back plate 135 is slidable along a guide bar 138 through a bearing (not shown). The guide bar 138 extends parallel to the conveying direction A. Accordingly, the back plate 135 is not only slidable in the conveying direction A, but also manually rotatable around the guide bar 138. The guide plate 135 is perpendicularly placed on the conveyor belts 134 with a lower end portion thereof positioned between two adjacent ones of the teeth of the conveyor belts 134. Thus, the conveyor 133 conveys the flat articles 11 towards the feed belts 143 to bring at least one of the flat articles 11 into contact with the feed belts 143 as a conveyed article. The flat articles 11 are successively pushed to the feed belts 143 with a contact pressure. A similar type conveyor is disclosed in U.S. Pat. No. 4,643,626 issued to Masahiko Noguchi, namely, the instant applicant, et al and assigned to NEC Corporation.

First photoelectric detector 171 is arranged on the base member 12 as a first detector so as to detect the conveyed article. The first photoelectric detector 171 produces a first detection signal upon detection of the conveyed article. The first detection signal is sent to the controller to control the feeder 14 as will later be described.

In the embodiment being illustrated, the following roller 142 is rotatably and swingably supported by the base member 12 so that the following roller 142 is swingable around an axis of the driving roller 141. In order to hold the following roller 142 against the contact pressure of the flat articles 11, a compression spring 172 is attached between the base member 12 and the following roller 142 below the base member 12. Alternatively, the compression spring 172 may be replaced by a tension spring extended in a direction reverse relative to the compression spring 172. It is to be noted here that the contact pressure acts on the following roller 142 through the feed belts 143. In order to detect the contact pressure through the following roller 142, a pressure detector 173 is used under the base member 12 as a second detector. When the contact pressure rises to a predetermined value, the pressure detector 173 produces a second detection signal to send the second detection signal to the controller for controlling the conveyor motor 136 as will later be described. The pressure detector 173 may be implemented by a microswitch which is mechanically coupled to the following roller 142.

Under the control of the controller, the feeder 14 feeds the particular article outwardly of the feeder 14 as a fed-out article in cooperation with the conveyor 133.

The apparatus further comprises a pick-up roller 174 and an idler roller 175. Indicated by a reference numeral 176, the afore-mentioned common motor is positioned under the base member 12 and is used in driving the driving roller 141 and the pick-up roller 174. The pick-up roller 174 and the idler roller 175 are rotatably supported by the base member 12 with their axes directed vertically. The pick-up roller 174 is for picking up the fed-out article to feed the fed-out article outwardly of the apparatus as the output article in cooperation with the idler roller 175. Incidentally, the idler roller 175 may be urged towards the pick-up roller 174 in the manner known in the art.

The output article is fed to the utilizing device, such as the bar code printer 170 after it is stopped at a presentation stage. At the presentation stage, the input data, such as the zip code number, are supplied to the bar code printer by an operator by the use of the keyboard. Thereafter, the bar code printer 170 prints bar codes on the flat articles based on input data. The controller carries out a controlling operation of the flat article feeding apparatus in relation to operation of the bar code printer 170 as will later be described in detail.

First and second electromagnetic couplings (not shown) are coupled to the driving roller 141 and the pick-up roller 174, respectively, under the base member 12. The driving roller 141 and the pick-up roller 174 are connected to the common motor 174 by means of an endless common driving belt 177 through the first and the second electromagnetic couplings. Controlled by the controller, the first and the second electromagnetic couplings individually connect and disconnect the driving roller 141 and the pick-up roller to the common motor 176. Under the circumstances, the common motor 176 is continuously driven. In addition, first and second electromagnetic brakes (not shown) are coupled to the driving roller 141 and the pick-up roller 174, respectively, under the base member 12. Controlled by the controller, the first and the second electromagnetic brakes individually stop the rotation of the driving roller 141 and the pick-up roller 174 when the driving roller 141 and the pick-up roller 174 are disconnected from the common motor 176.

Second photoelectric detector 178 is arranged above the base member 12 as a third detector so as to detect whether or not the fed-out article arrives at the pick-up roller 174. The second photoelectric detector 178 produces a third detection signal upon detection of arrival of the fed-out article at the pick-up roller 174. The second photoelectric detector 178 sends the third detection signal to the controller for the controlling operation as will later be described.

At downstream of the fed-out article relative to the pick-up roller 174, a third photoelectric detector 179 is arranged above the base member 12 as a fourth detector so as to detect the afore-mentioned output article fed from the pick-up roller 174 outwardly of the flat article feeding apparatus. The third photoelectric detector 179 produces a fourth detection signal upon detection of the output article to send the fourth detection signal to the controller for the controlling operation.

Incidentally, the driving shaft 151 is driven by a pulley driving motor 180 situated under the base member 12. The controller controls the pulley driving motor 180 as will shortly be described. Each of the first through the third photoelectric detector may be implemented by a photocoupler.

Figure 5:
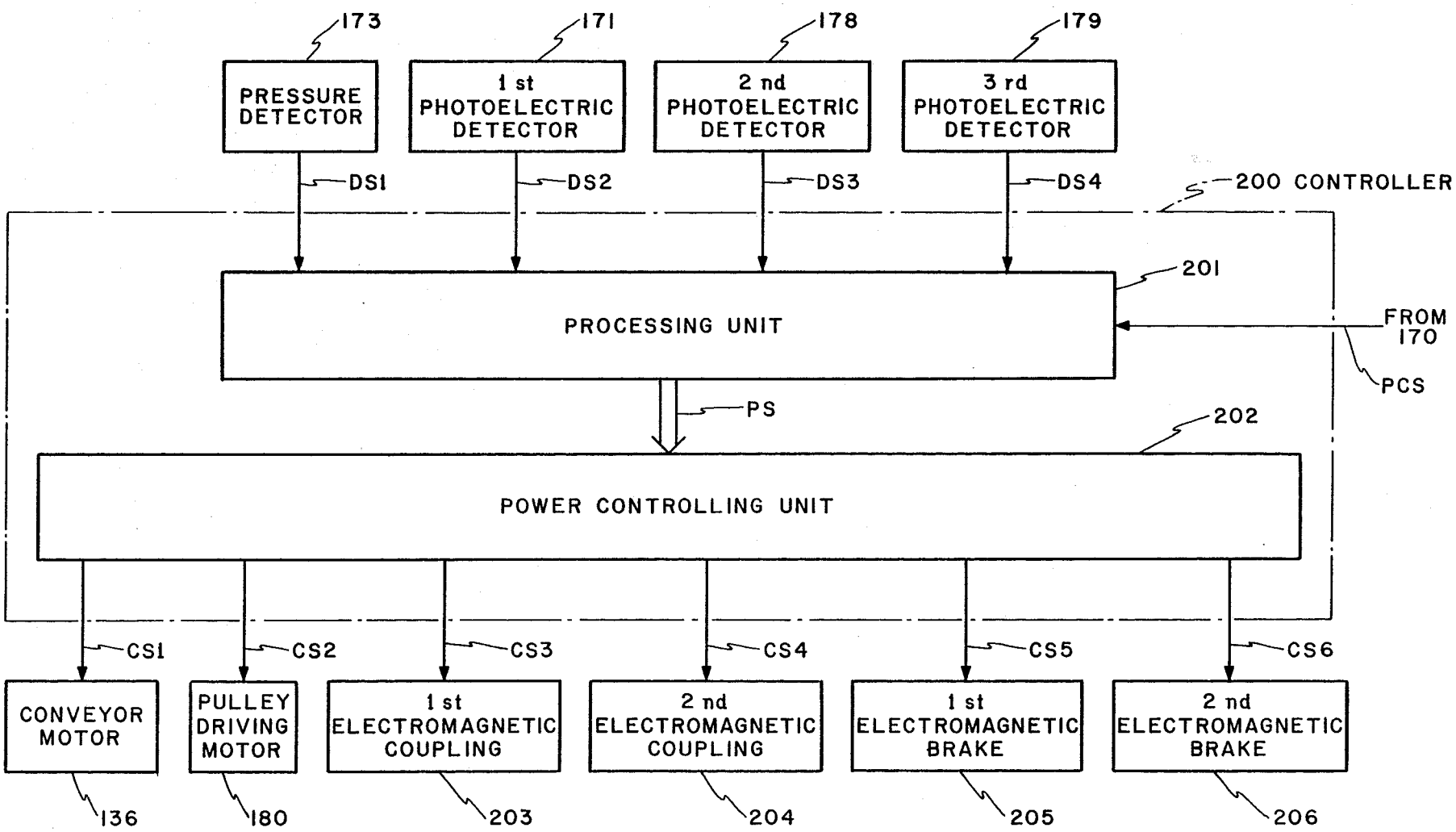
FIG. 5 is a block diagram of a controller for use in controlling the flat article feeding apparatus illustrated in FIG. 4.

Referring to FIG. 5 together with FIG. 4, description will be made as regards the controller. Depicted in FIG. 5 at 200, the controller comprises a processing unit 201 and a power controlling unit 202. The processing unit 201 receives the first through the fourth detection signals indicated at DS1, DS2, DS3, and DS4 sent from the pressure detector 173 and the first through the third photoelectric detector 171, 178, and 179. The processing unit 201 further receives a print completion signal PCS sent from the bar code printer 170 described before. The processing unit 201 carries out a predetermined processing operation to produce a processed signal PS to deliver the processed signal PS to the power controlling unit 202. The processed signal is for controlling the conveyor motor 136, the pulley driving motor 180, first and second electromagnetic couplings 203 and 204, and the first and the second electromagnetic brakes which are now depicted at 205 and 206. In response to the processed signal PS, the power controlling unit 202 produces first through sixth control signal CS1, CS2, CS3, CS4, CS5, and CS6. The conveyor motor 136 and the pulley driving motor 180 are put in rotation on reception of the first and the second control signals CS1 and CS2, respectively. The first electromagnetic coupling 203 connects the driving roller 141 to the common motor 176 during reception of the third control signal CS3. Similarly, the second electromagnetic coupling 204 connects the pick-up roller 174 to the common motor 176 in response to the fourth control signal CS4. The first electromagnetic brake 205 stops the rotation of the driving roller 141 during reception of the fifth control signal CS5. The second electromagnetic brake 206 stops the rotation of the pick-up roller 174 during reception of the sixth control signal CS6.

Figure 6:
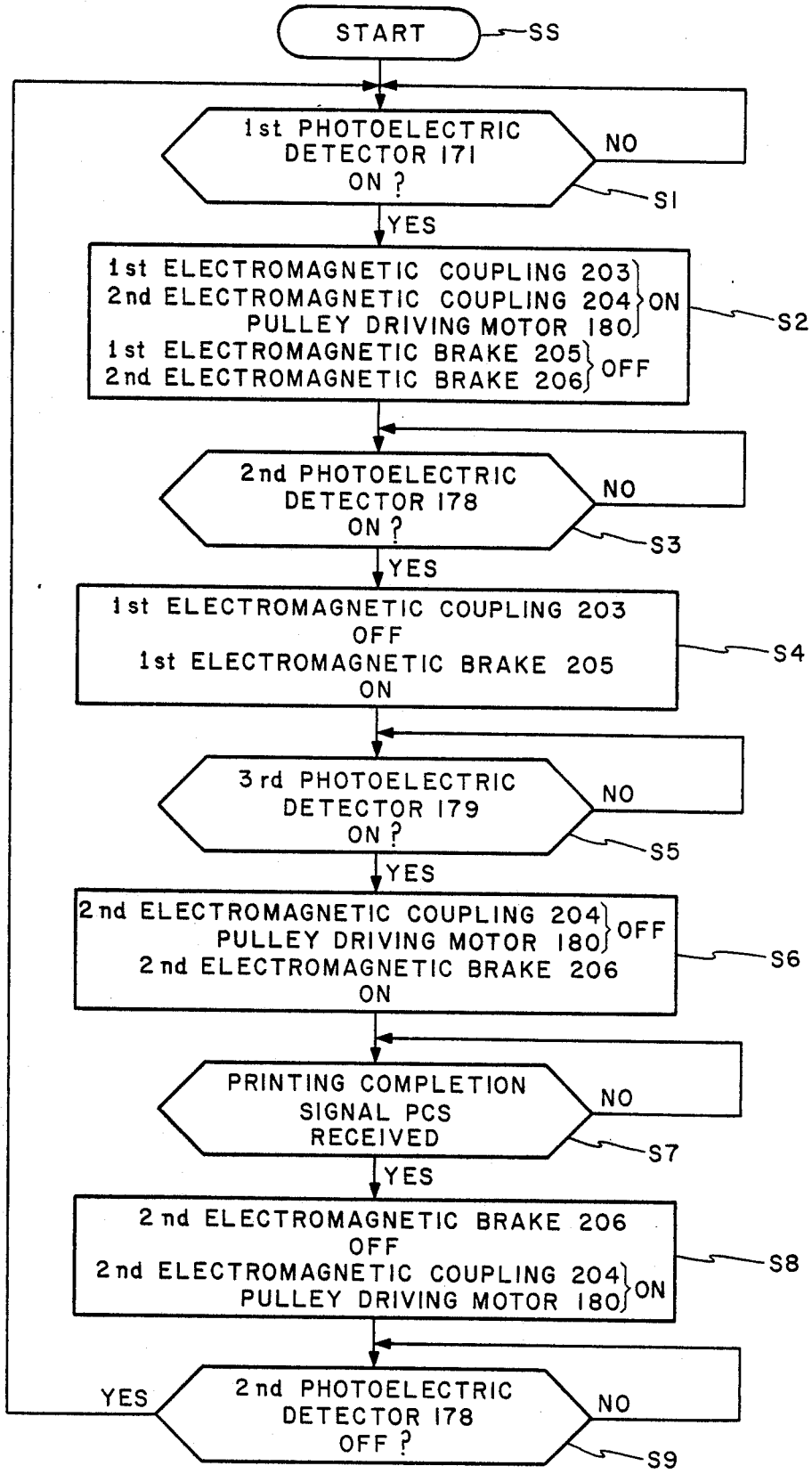
FIG. 6 is a flow chart for use in describing controlling operation of the controller illustrated in FIG. 5.
Figure 7:
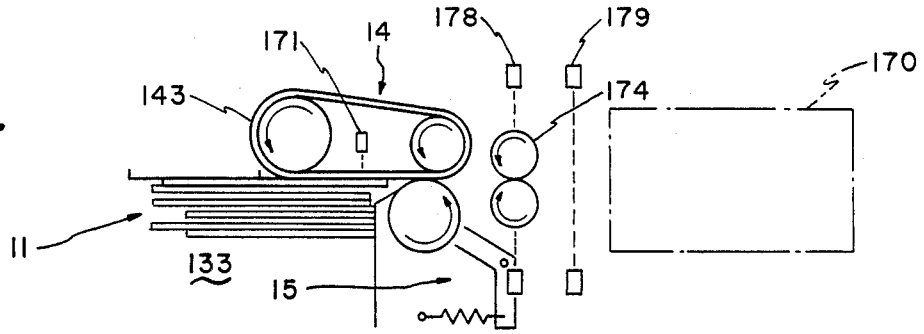
FIGS. 7(*a*), 7(*b*), 7(*c*), 7(*d*), and 7(*e*) are schematic plan views illustrating several steps of feeding operation of the flat article feeding apparatus illustrated in FIG. 4.
Figure 7:
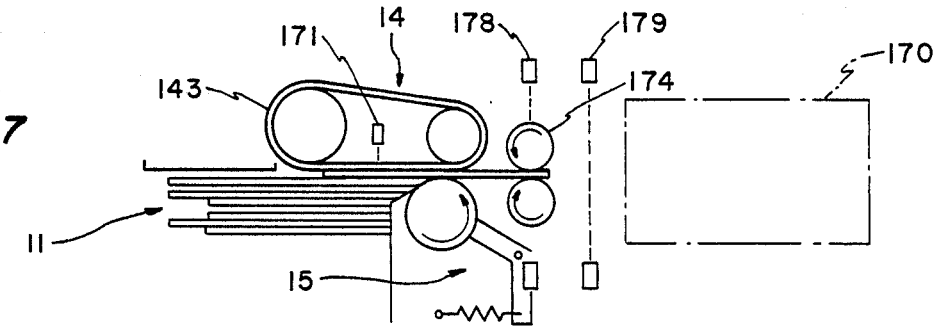
Figure 7:
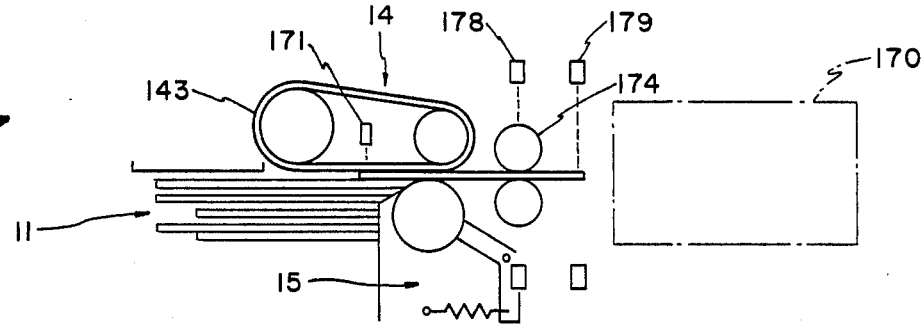
Figure 7:
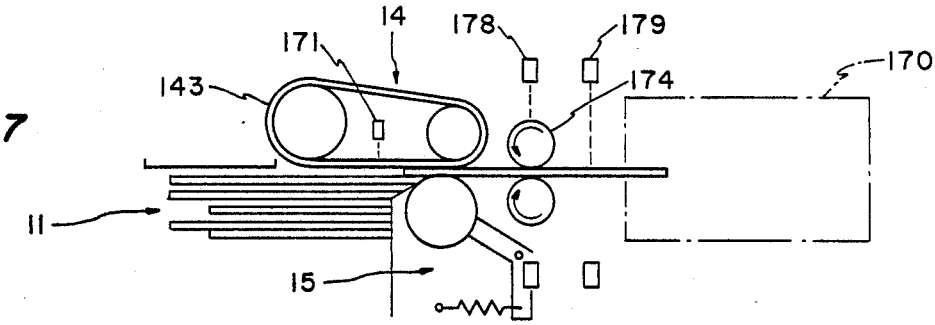
Figure 7:
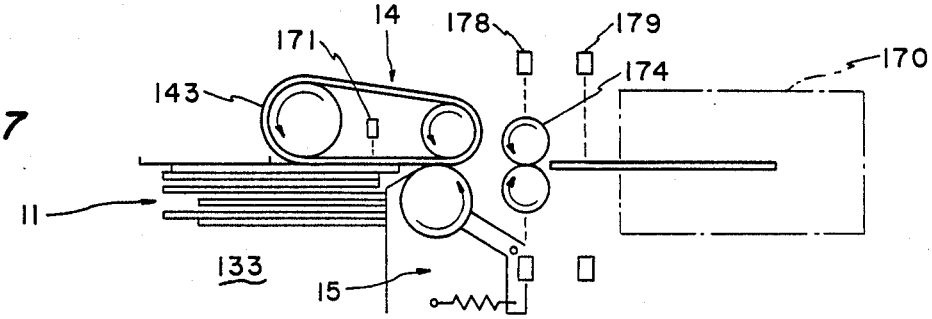

Referring to FIGS. 6 and 7 together with FIGS. 4 and 5, the controlling operation of the controller will be described in detail. In FIG. 6, the flat article feeding apparatus is put into an initial state when a power source switch (not shown) of the apparatus is closed at a start stage SS. The controller 200 starts the common motor 176 at the start stage SS. Regardless of the second through the fourth detection signals DS2 to DS4, the controller 200 drives the conveyor motor 136 only when the pressure detector 173 produces the first detection signal DS1. In other words, the controller 200 drives the conveyor motor 136 only when the contact pressure is not higher than the predetermined value. Thus, the conveyor 133 pushes the flat articles 11 to the feed belts 143 with the contact pressure.

The start stage SS proceeds to a first stage S1 at which the controller 200 carries out an operation to discriminate whether or not the first photoelectric detector 171 detect the particular article. When the first photoelectric detector 171 detects the particular article, the first stage S1 is followed by a second stage S2. Otherwise, the apparatus returns to the initial state. At the second stage S2, the controller 200 starts the pulley driving motor 180 and turns on the first and the second electromagnetic couplings 203 and 204. On the other hand, the first and the second electromagnetic brakes 205 and 206 remain in off states. The second stage S2 is shown by FIG. 7(*a*). In FIG. 7(*a*), the conveyor 133 conveys the flat articles 11 in the conveying direction and pushes the flat articles 11 to the feed belts 143. On the other hand, the feeder 14 feeds the particular article outwardly of the feeder 14 as the fed-out article. At this time, the reversedly driven pulley mechanism 15 acts so as to avoid the overlap feed.

A third stage S3 follows the second stage S2 to detect the fed-out article by the use of the second photoelectric detector 178. When the second photoelectric detector 178 detects the fed-out article, the third stage S3 is followed by a fourth stage S4. Otherwise, the third stage S3 is repeated again. At the fourth stage S4, the controller 200 turns off the first electromagnetic coupling 203 and turns on the first electromagnetic brake 205. The fourth step S4 is shown by FIG. 7(*b*). In FIG. 7(*b*), the feeder 14 stops the feed out operation while the pick-up roller 174 picks up the fed-out article and transports the fed-out article outwardly of the pick-up roller 174 as the output article. In the fourth stage S4, the reversedly driven pulley mechanism 15 further acts so as to avoid the overlap feed.

A fifth stage S5 follows the fourth stage S4 to detect the output article by the use of the third photoelectric detector 179. When the third photoelectric detector 179 detects the output article, the fifth stage S5 is followed by a sixth stage S6. Otherwise, the fifth stage S5 is repeated again. At the sixth stage S6, the controller 200 turns off the second electromagnetic coupling 204 and the pulley driving motor 180 and turns on the second electromagnetic brake 206. The sixth stage S6 is shown by FIG. 7(*c*). In FIG. 7(*c*), the reversedly driven pulley mechanism 15 and the pick-up roller 174 stop these operation.

A seventh stage S7 follows the sixth stage S6 to wait for completion of a keying operation carried out by the operator. Although the output article does not yet reach the bar code printer at the sixth stage S6 which may be called a presentation stage, it is assumed that the bar code printer has already received another output article as a former preceding article. In this event, the bar code printer produces the printing completion signal PCS on completion of the printing operation of the former preceding article. When the controller 200 receives the printing completion signal PCS from the bar code printer, the seventh stage S7 is followed by an eighth stage S8. Otherwise, the seventh stage S7 is repeated again.

At the eighth stage S8, the controller 200 turns off the second electromagnetic brake 206 and turns on the second electromagnetic coupling 204 and starts the pulley driving motor 180. The eighth stage S8 is shown by FIG. 7(*d*). In FIG. 7(*d*), the pick-up roller 174 transports the fed-out article to the bar code printer 170 as the output article.

A ninth stage S9 follows the eighth stage S8 to detect pass through of an end portion of the fed-out article by the use of the second photoelectric detector 178. When the third detection signal disappears, the flat article feeding apparatus returns to the initial state. It will be seen in FIG. 7(*e*) that, when the output article is completely transported from the pick-up roller 174 to the bar code printer and when the next following article is detected by the first photoelectric detector 171, the feeder 14 starts the feed operation again.

The control operation described above, is repeated until stop indication is produced by a stop switch. Thus, the flat article feeding apparatus feeds the flat articles 11 one by one in accordance with an operating state of the bar code printer.

While this invention has thus far been described in conjunction with a few preferred embodiments thereof, it will readily be possible for those skilled in the art to put this invention into practice in various other manners. For example, the first through the third photoelectric detectors 171, 178, and 179 are implemented by the photoelectric detectors of a reflecting type. The feeder 14, the reversedly driven pulley mechanism 15, and the pick-up roller 174 may have their rotary axes directed horizontally. In this event, a plurality of flat articles are stacked horizontally on the feed belts of the feeder. The conveyor can therefore be omitted.

What is claimed is:

1. Flat article feeding apparatus comprising:

an endless feed belt defining a feed plane at a predetermined portion thereof;

first driving means for driving said feed belt to make said feed belt feed a plurality of approximately flat articles one by one with each of said flat articles fed substantially along said feed plane;

a predetermined number of idler pulleys;

pulley supporting means for supporting said idler pulleys substantially perpendicular to said feed plane;

urging means for individually urging said idler pulleys towards said feed plane so that said idler pulleys are in contact with one of said flat articles that is fed on said feed plane as a particular article; and second driving means for driving said idler pulleys to make said idler pulley reversedly feed said particular article, thereby avoiding overlap of the flat articles being fed by said feed belt.

2. Flat article feeding apparatus as claimed in claim 1, wherein:

said second driving means comprises a driving shaft for rotating said idler pulleys reversedly relative to the flat articles being fed by said feed belt;

said pulley supporting means comprising a plurality of arms swingably around said driving shaft for rotatably carrying the respective idler pulleys.

3. Flat article feeding apparatus as claimed in claim 2, wherein said urging means comprises:

an adjusting member movable relative to said driving shaft; and a plurality of coil springs between said adjusting member and the respective arms to urge said idler pulleys towards said feed plane.

4. Flat article feeding apparatus as claimed in claim 3, each of said idler pulleys being urged towards said feed plane with an adjustable force, wherein said urging means further comprises a plurality of stoppers coupled to the respective arms to individually adjust the adjustable forces for said idler pulleys in cooperation with said adjusting member.

5. Flat article feeding apparatus as claimed in claim 1, said endless feed belt being for feeding said particular article outwardly thereof as a fed-out article, said flat article feeding apparatus further comprising:

conveyor means for conveying said flat articles towards said feed belt to bring at least one of said flat articles into contact with said feed belt with a contact pressure as a conveyed article;

first detecting means coupled to said conveyor means for detecting said conveyed article to produce a first detection signal upon detection of said conveyed article;

second detecting means coupled to said first detecting means for detecting said contact pressure to produce a second detection signal when said contact pressure rises to a predetermined value;

third detecting means coupled to said pick-up means for detecting whether or not said fed-out article arrives at said pick-up means, said third detecting means producing a third detection signal upon detection of arrival of said fed-out article at said picked-up means; and controlling means responsive to said first through said third detection signals for controlling said first and said second driving means, and said conveyor means.

6. Flat article feeding apparatus as claimed in claim 5, wherein said controlling means is for controlling said first and said second driving means, said conveyor means, and said pick-up means only during reception of said first detection signal.

7. Flat article feeding apparatus as claimed in claim 6, wherein said controlling means is for driving said conveyor means during absence of said second detection signal.

8. Flat article feeding apparatus as claimed in claim 6, wherein said controlling means is for making said first driving means suspend drive of said feed belt during reception of said third detection signal.

9. Flat article feeding apparatus as claimed in claim 6, said flat article feeding apparatus being coupled to a utilizing device for feeding said particular article to said utilizing device as an output article, said utilizing device being for carrying out a predetermined process on said output article and producing a completion signal upon completion of said predetermined process, wherein said flat article feeding apparatus further comprises:

pick-up means for picking up said fed-out article to feed said fed-out article outwardly of said apparatus as said output article; and fourth detecting means downstream relative to said pick-up means for detecting said output article to produce a fourth detection signal upon detection of said output article;

said controlling means being for preventing said first detection signal from controlling said first andd said second driving means and suspending operation of said pick-up means from an instant of reception of said fourth detection signal until a later instant of reception of said completion signal while leaving said conveyor means in operation.

* * * * *